US010669668B2

(12) United States Patent
Goodson et al.

(10) Patent No.: US 10,669,668 B2
(45) Date of Patent: Jun. 2, 2020

(54) CLOTHES DRYER FIRE REDUCTION SYSTEM

(71) Applicants: Mark Goodson, Corinth, TX (US); David J. Icove, Knoxville, TN (US)

(72) Inventors: Mark Goodson, Corinth, TX (US); David J. Icove, Knoxville, TN (US)

( * ) Notice: Subject to any disclaimer, the term of this patent is extended or adjusted under 35 U.S.C. 154(b) by 0 days.

(21) Appl. No.: 16/200,121

(22) Filed: Nov. 26, 2018

(65) Prior Publication Data

US 2019/0161907 A1 May 30, 2019

Related U.S. Application Data

(60) Provisional application No. 62/591,544, filed on Nov. 28, 2017.

(51) Int. Cl.

| | |
|---|---|
| ***F26B 7/00*** | (2006.01) |
| ***D06F 58/30*** | (2020.01) |
| *D06F 58/38* | (2020.01) |
| *D06F 58/50* | (2020.01) |
| *D06F 103/00* | (2020.01) |
| *D06F 103/10* | (2020.01) |
| *D06F 103/36* | (2020.01) |
| *D06F 105/24* | (2020.01) |

(52) U.S. Cl.

CPC ..... *D06F 58/30* (2020.02); *D06F 58/38* (2020.02); *D06F 58/50* (2020.02); *D06F 2103/00* (2020.02); *D06F 2103/10* (2020.02); *D06F 2103/36* (2020.02); *D06F 2105/24* (2020.02)

(58) Field of Classification Search

CPC ..... D06F 2058/2838; D06F 2058/2858; D06F 2058/2854; D06F 58/28

USPC ..... 34/380, 389, 250, 254, 108

See application file for complete search history.

(56) References Cited

U.S. PATENT DOCUMENTS

| | | | | |
|---|---|---|---|---|
| 3,221,417 | A | | 12/1965 | Mellinger |
| 3,471,940 | A | | 10/1969 | Smith |
| 3,526,968 | A | | 9/1970 | Triplett |
| 3,593,544 | A | | 7/1971 | Henderson |
| 3,782,001 | A | * | 1/1974 | Cotton ..... D06F 58/28 34/532 |
| 4,019,259 | A | | 4/1977 | Veraart |
| 4,546,554 | A | | 10/1985 | Bullock et al. |
| 5,097,606 | A | | 3/1992 | Harmelink et al. |
| 5,101,575 | A | | 4/1992 | Bashark |
| 5,166,592 | A | | 11/1992 | Bashark |
| 5,228,212 | A | | 7/1993 | Turetta et al. |
| 5,281,956 | A | | 1/1994 | Bashark |
| 6,047,486 | A | | 4/2000 | Reck et al. |
| 6,122,840 | A | | 9/2000 | Chbat et al. |

(Continued)

*Primary Examiner* — John P McCormack

(74) *Attorney, Agent, or Firm* — Gunn, Lee & Cave, PC

(57) ABSTRACT

A clothes dryer apparatus and system that reduces the buildup of electric charges within a dryer drum by introducing ions. The system monitors the voltage within the drum by taking measurements on voltage sensor assembly. The sensor assembly obtains a voltage when two areas of a fabric, or two separate items of the clothing, contact the sensor. If a threshold voltage is obtained, an ion generator introduces cations and anions into the drum of the dryer to neutralize the static charge of the clothing. The reduction of static electricity increases efficiency as the clothing items do not stick together which permits better heat flow and increases safety by reducing the amount of electrical charge within the drum.

9 Claims, 5 Drawing Sheets

(56) References Cited

U.S. PATENT DOCUMENTS

| | | | | |
|---|---|---|---|---|
| 6,141,887 | A | 11/2000 | Chen et al. | |
| 6,449,876 | B1 | 9/2002 | Parsell | |
| 7,020,985 | B2 | 4/2006 | Casey et al. | |
| 7,345,491 | B2 | 3/2008 | Peziel | |
| 7,345,497 | B2 | 3/2008 | Matsuno | |
| 7,475,495 | B2 | 1/2009 | Chiles et al. | |
| 7,997,005 | B2 * | 8/2011 | Monk | H01Q 1/002 34/380 |
| 2004/0006886 | A1 | 1/2004 | Lee et al. | |
| 2004/0216326 | A1 * | 11/2004 | Kitamura | D06F 25/00 34/597 |
| 2005/0076534 | A1 * | 4/2005 | Ofosu-Asante | D06F 35/00 34/597 |
| 2006/0272177 | A1 | 12/2006 | Pezier et al. | |
| 2007/0006484 | A1 | 1/2007 | Moschuetz et al. | |
| 2007/0271966 | A1 * | 11/2007 | O'Brien | C11D 17/047 68/2 |
| 2009/0064422 | A1 | 3/2009 | Kim et al. | |
| 2009/0217547 | A1 * | 9/2009 | Kim | D06F 25/00 34/275 |
| 2011/0197466 | A1 * | 8/2011 | Shami | A45D 20/12 34/283 |
| 2012/0000276 | A1 | 1/2012 | Cinar et al. | |
| 2012/0006996 | A1 * | 1/2012 | Nishino | H01T 23/00 250/395 |
| 2013/0192081 | A1 * | 8/2013 | Zambrowicz | D06F 58/04 34/282 |
| 2016/0374447 | A1 * | 12/2016 | Sterling | A45D 20/08 34/275 |

* cited by examiner

CLOTHES DRYER FIRE REDUCTION SYSTEM

CROSS-REFERENCES TO RELATED APPLICATIONS

This application claims the benefit of U.S. Provisional Application Ser. No. 62/591,544 filed Nov. 28, 2017 entitled Improved Clothes Dryer. The contents of said application are incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to clothes dryers, and more specifically, a system to prevent fire by reducing the buildup of static electricity during the drying cycle and by reducing the potential for spontaneous combustion.

2. Description of the Related Art

A clothes dryer generally comprises a cabinet, a drum, motor, mechanism for spinning the drum, a heating element, and electronic controls. The user inserts damp clothes into the dryer drum. The clothes dryer is then powered on, and the drum rotates causing the clothes to tumble while a stream of heated air is blown into the drum and contacts the clothes. The heated air removes water from the clothes over time.

The tumbling of the clothes creates friction between pieces of drying fabric by causing different pieces of clothing and different layers of the same piece of clothing to rub against each other. The coulomb friction caused by the clothes rubbing together causes electrical charges to be built up and stored within the fabric of the clothes. Some fabrics receive electrons causing them to have a negative charge whereas other fabrics donate electrons causing them to have a positive charge.

The buildup of static electric charges in the drying fabric causes the clothes to clump together based on the attraction between a positively charged clothing item to a negatively charged clothing item. The clumping together impedes circulation of the heated air throughout the drum making it more difficult and time consuming for the heated air to effectively dry the clothes. As a result, the user must increase the temperature of the heated air or increase the length of the drying cycle in order to dry the clothes. These options increase the risk of fire and are not energy efficient.

In addition, it is not uncommon for clothes to be left overnight (or even longer) undisturbed in a clothes dryer after the drying cycle is completed. Even after the dryer shuts off, the undisturbed mass of hot clothes, or portions thereof, may continue to self-heat depending on the presence of certain fats/oils that were not removed during the washing process. This heat can continue to build up on the clothes which can promote spontaneous combustion and a resultant fire.

One product design intended to reduce clothes clumping during the drying cycle was the introduction of metal fins in the drum. See U.S. Pat. No. 4,190,874. However, the metal fins create inefficiencies by absorbing the heat that should be delivered to the damp clothes. U.S. Pat. No. 5,416,983 teaches the use of conductive material in order to reduce static electricity build-up in the drum but this is inefficient as it relies on necessary contact with the clothes in order to dissipate the static electricity. During a cycle in the dryer, the clothes do not all touch the drum continuously resulting in inefficient static reduction. Another solution is to use anti-clump fabric sheets that are separately purchased by the consumer and put into the drum with the clothes. However, this solution generates extra expense for the user and requires the user to remember to purchase and insert the sheets.

The aforementioned solutions are imperfect and there remains a need to develop a clothes dryer with the ability to efficiently eliminate static electricity build up during the drying cycle.

BRIEF SUMMARY OF THE INVENTION

The present invention is a dryer with the capability to monitor electrical charge within the drum and turn off the flow of heated air when the electrical charge reaches a designated threshold. Once the threshold is reached, ion rich air is introduced into the drum through an ion generator. The ion rich air interacts with and neutralizes the built-up static electric charge within the drum and the clothes. The ion rich air stream penetrates the fabric layers allowing contact with the interior fabric layers. This increases the amount of contact between the ion rich air and static electricity resulting in increased neutralization of the static electricity and more effective de-clumping of the clothes which increases surface area of the clothing to allow for more efficient moisture removal.

The present invention further reduces the potential for an internal fire by decreasing the conditions necessary for spontaneous combustion. A controller measures the time between the completion of the drying cycle and when the dryer door is opened as detected by the door sensor. If a sufficient time has passed without the door opening, the controller turns on the drum to permit it to rotate for a designated period of time without introduction of heat. The tumbling of clothes permits exposure to the air within the drum allowing any entrapped heat to dissipate. At the same time, a light radiation source (UV light or LED) is turned on during the additional tumbling cycle. Any moisture remaining within the clothes creates an environment for microbes to grow which generates heat. The visible and invisible optical radiation generated by the light helps destroy microbes. Thus, the tumbling after drying aerates the clothes, dissipates entrapped heat, and destroys microbes reducing the potential for spontaneous combustion.

DETAILED DESCRIPTION OF THE INVENTION

Figure 1:
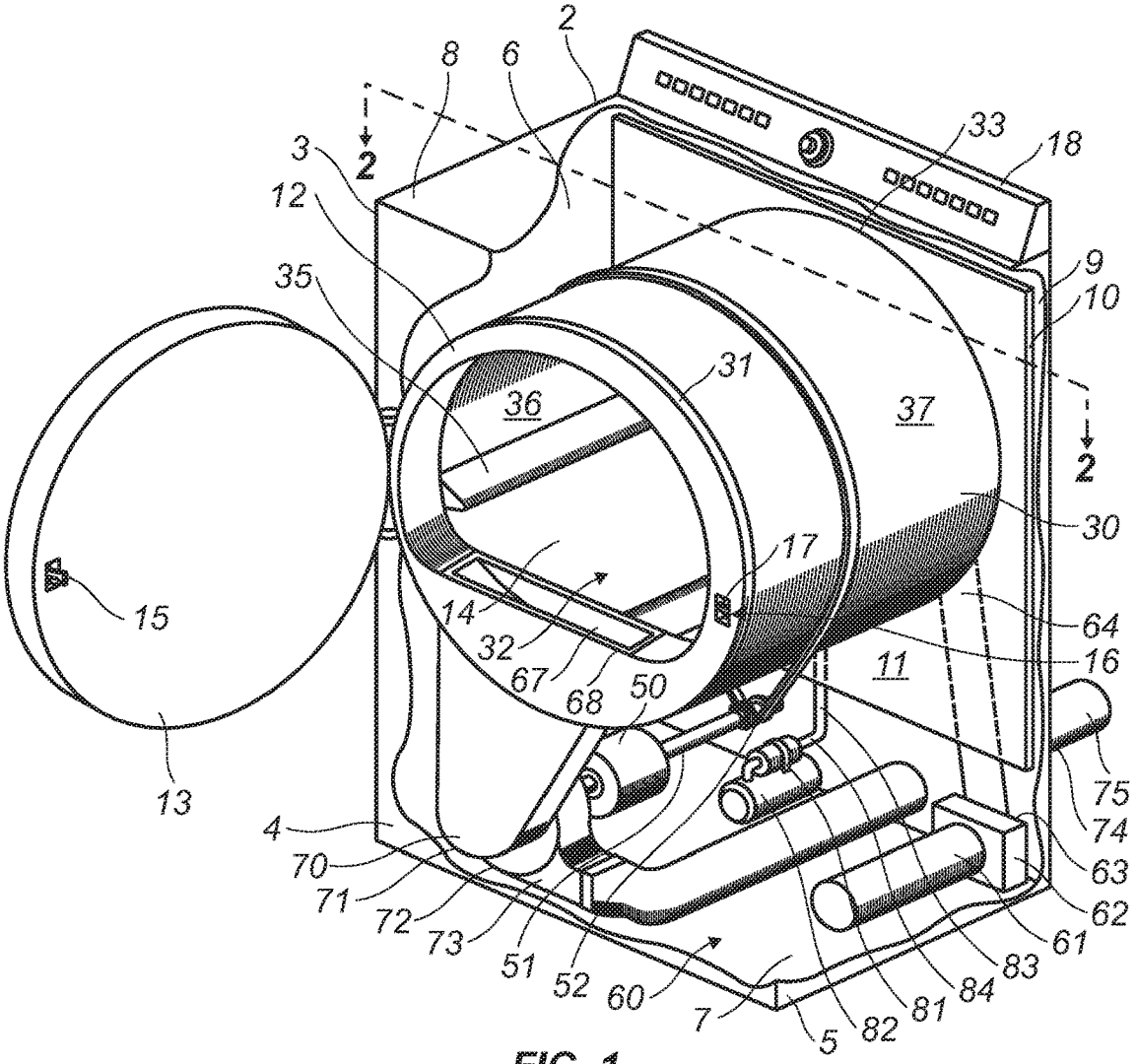
FIG. 1 is a partially broken perspective view of a clothes dryer with an embodiment of the clothes dryer static electricity reduction system.

As seen in FIG. 1, an embodiment of the clothes dryer static electricity reduction system 1 is positioned within a generally standard dryer 2 having a cabinet 3, drum 20, motor 50, heater/blower system 60, and ion generator system 80. The cabinet 3 of the disclosed embodiment comprises a front panel 4, first side panel 5, second side panel 6, bottom panel 7, top panel 8 and rear panel 9 arranged in a generally cuboid box-like shape. An interior panel 10 is positioned within the cabinet 3. The front panel 4 further comprises a drum receptacle 12, door 13, and an opening 14. The door 13, when closed, covers the opening 14. A drum latch 15 is positioned on the interior of the door 13. A latch receptacle 16 is positioned on the drum receptacle 12 and capable of receiving the door latch 13 in such a manner that the door 13 is shut against the door receptacle 12. A door sensor 17 is in communication with the latch receptacle 16 and can determine if the door is open or closed. As seen in FIG. 1, the drum receptacle 12 is shown separate from the front panel 4 but is generally integral with the first panel 4. Alternatively, the interior panel 10 and the rear panel 9 may be the same.

The drum 30 is positioned inside the cabinet 3 between the front panel 4 and the interior panel 10. The drum 30 is cylindrically shaped with a front circular edge 31 defining an open front end 32 and a rear circular edge 33 defining an open rear end 34. The drum 30 rests on a wheel assembly (not shown) which is well known in the art. The front circular edge 31 seals against the drum receptacle 12 such that the drum 30 may rotate while the drum receptacle 12 remains stationary. A portion of the open front end 32 corresponds with opening 14. The door 13, when closed, covers the open front end 32. The rear circular edge 33 of the drum 30 seals against the front surface 11 of the interior panel 10 such that the drum 30 may rotate while the interior panel 10 remains stationary. Connections of the drum to the interior panel 10 and the drum receptacle 12 are well known in the art. A portion 19 of the front surface 11 of the interior panel 10 is exposed to the interior of the drum 30 through the open rear end 34.

In the disclosed embodiment, a motor 50 having a drive shaft 51 is mounted to the bottom panel 7 of the cabinet 3. A drive belt 52 wraps around the outer surface 37 of the drum 30 and is rotatably attached to the drive shaft 51. In operation, the motor 50 spins the drive shaft 51 ultimately causing the drive belt 52 (and drum 30) to spin. Such operation is well known in the art and may include idler pulleys and other mechanisms that control revolution of the drum 30.

The drum 30 has baffles 35 protruding from the interior surface 36 of the drum 30. In an embodiment of the clothes dryer static electricity reduction system, the baffles 35 are constructed from a plastic material impregnated with carbon fiber or aluminum shards. A typical dryer has three baffles 35 that run longitudinally (extending from the front circular edge 31 to the rear circular edge 33) and are generally spaced one hundred and twenty degrees relative to another.

An ultraviolet light 40 is mounted to the interior panel 10 such that it emanates light into the interior of the drum 30. The ultraviolet light 40 may be an LED light, non-visible laser, or other ultraviolet source. The ultraviolet light 40 may be of sufficient strength to kill, sterilize, and/or limit growth of mold and mildew within the drum 30 and/or clothes within the drum 30.

The heater and blower system of a typical dryer are well known in the art. The air supply intake 61 is fluidly connected to the heater housing 62. A heating element 76 is positioned within heater housing 62 and is controlled by a thermostat 77. The first end 63 of the drum inlet conduit 64 is fluidly connected to the heater housing 62 and the second end 65 of the drum inlet conduit 64 is fluidly connected to the drum inlet 66 of the interior panel 10. The drum inlet 66 is in fluid communication with the interior of the drum 30. A drum outlet 67 is in fluid communication with the interior of the drum 30 and positioned within the drum receptacle 12. A lint catcher 68 may be placed within the drum outlet 67. The first end 69 of the drum outlet conduit 70 is fluidly connected to the drum outlet 67 and the second end 71 of the drum outlet conduit 70 is fluidly connected to the blower housing 72. A blower wheel is positioned within the blower housing 72 and connected to the drive shaft 51. The first end 73 of the exhaust conduit 74 is fluidly connected to the blower housing 72. The exhaust conduit 74 extends through the rear panel 9 of the cabinet 3 and terminates in an outlet 75. The outlet 75 may be fluidly connected to an additional conduit that routes exhaust outside a room. One skilled in the art understands that the location and design of the heat and exhaust system components varies between different styles and brands of dryers.

Figure 2:
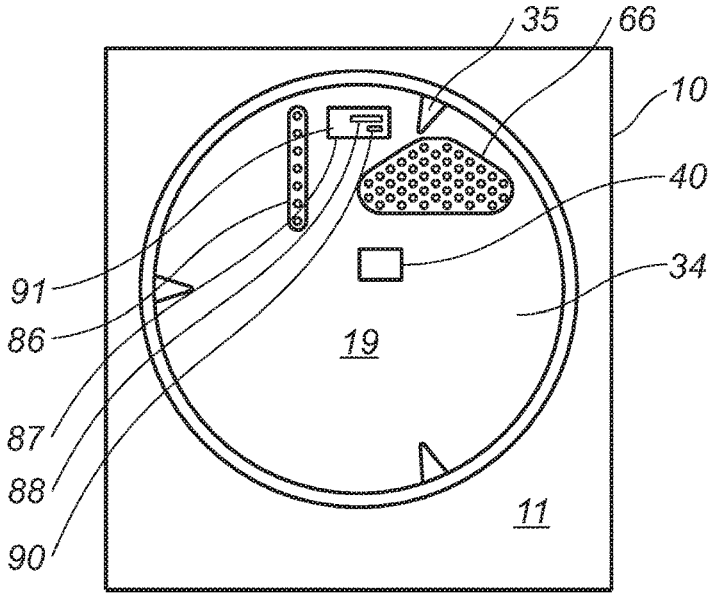
FIG. 2 is a front view of a vertical cross section of the drum with interior panel through line 2-2 in FIG. 1.
Figure 3:
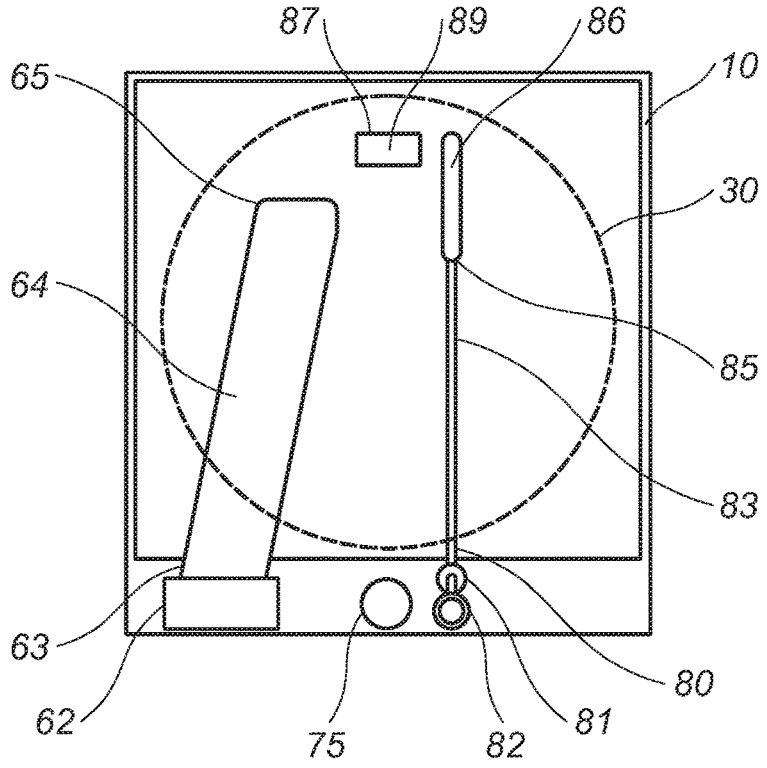
FIG. 3 is a rear view of a clothes dryer with an embodiment of the clothes dryer static electricity reduction system.

As seen in FIGS. 1-3, the ion generator system 80 comprises an ion generator 81 fluidly connected to an air compressor 82. The ion generator system 80 further comprises a non-metallic conduit 83 with the first end 84 in fluid communication with the ion generator 81 and the second end 85 of the non-metallic conduit 83 is fluidly connected to the ion inlet 86 of the interior panel 10. The ion inlet 86 is in fluid communication with the interior of the drum 30. The ion generator system 80 further comprises a voltage sensor assembly 87 further comprising a sensor 88 and a voltmeter 89. In the disclosed embodiment, the sensor is mounted on the interior face 11 of the interior panel 10 such that it can measure voltage from within the drum 30. In the disclosed embodiment the sensor 88 comprises two metal contact strips 90 imposed on a polymer block 91. The voltmeter detects the voltage differential between the two metal contact strips 90. In the disclosed embodiment the ion generator is a balanced ion generator generating cations and anions. The voltage sensor assembly 87 may be integral with ion generator 81 or a separate component. One skilled in the art understands the location and design of the sensor 88 may be varied depending on the components of the dryer and the sensor may be positioned in numerous locations so long as a voltage may be measured on clothing between two contact strips, regardless of where the contact strips are within the dryer. For example, the sensor may be the same type of voltage sensor utilized in existing dryers to determine moisture content of the clothes.

A controller 100 (identified in FIG. 5), or other logic board including processors, is in electronic communication with a control panel 18 on the cabinet 3, the door latch sensor 17, the heater/blower system 60, and the ion generator system 80. As found in industry standard dryers, the controller 100 may also be in electronic communication with various additional sensors and able to control the heater/blower system 60 based on inputs from the control panel 18, sensors of operation, and safety sensors related to performance of the heater/blower system 60. A power supply powers the light 40, motor 50, heater/blower system 60, the ion generator system 80, and the controller 100. Various additional relays, as known in the art, may be utilized such as a relay or switch between the controller 100 and the light 40, motor 50, heating element 76, thermostat 77, ion generator 81, and/or air compressor 82. Electronically, the ion system 80 may have other controls such as the light 40, ion generator 81, and/or air compressor 82 may not be able to turn on unless the motor 50 is operating.

Figure 4:
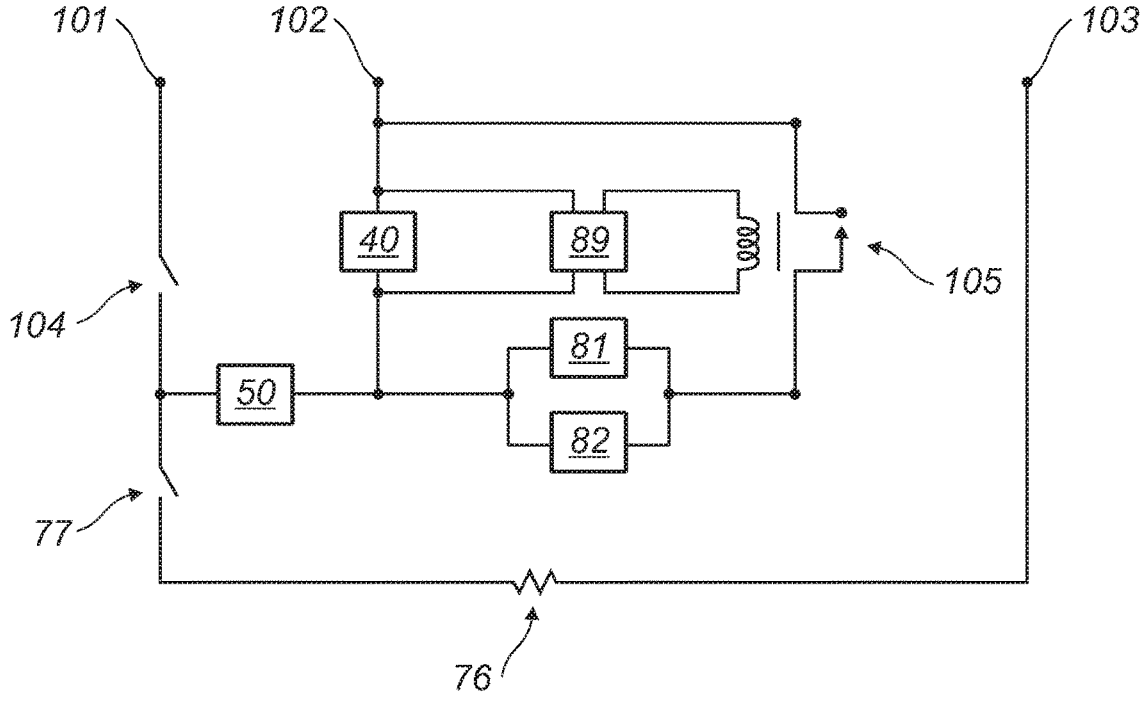
FIG. 4 is a partial circuit diagram of an embodiment of the clothes dryer static electricity reduction system.

FIG. 4 is a partial circuit diagram of the dryer 2. The supply conductors 101, 102, and 103 provide the power input for the dryer 2 with supply conductors 101 and 103 as 120 volt legs and supply conductor 102 as the neutral leg. Switch 104 is an on/off switch that controls power to the clothes dryer static electricity reduction system 1 and dryer 2. The supply conductors 101 and 103 provide two hundred and forty volts to the heating element 76 and thermostat 77 and one hundred and twenty volts to the motor 50, ion generator 81, air compressor 82, ultraviolet light 40, and voltmeter 89. A relay 105 is in electrical communication with the voltmeter 89 and when a certain threshold voltage is exceeded, be the relay 105 is activated to complete the circuit for power to flow to the ion generator 81 and air compressor 82.

It should be readily appreciated the circuitry may be configured in a multitude of ways to require certain precursors such that the motor 50 must be on before the ion generator 81, air compressor 82, ultraviolet light 40, and/or voltmeter 89 may operate. Conversely, the circuitry may be configured such that the air compressor 82 is always operating when the drum 30 to provide a continued flow of air to cool the ion generator 81 even when the ion generator 81 is not generating ions.

The operation of the clothes dryer static electricity reduction system is described in reference to FIGS. 1-5. The user opens the drum door 14 and inserts damp clothes and/or other materials into the drum 30 and closes the door 14. Using the control panel 18, the user selects the desired heating and dryer cycle. The standard heater/blower system 60 operates by powering the motor which rotates the drive shaft 51. The rotation of the drive shaft 51 causes the drive belt 52 to rotate which in turn causes the drum 30 to spin. Furthermore, the rotation of the drive shaft 51 also causes the blower wheel within the blower housing 72 to turn. The rotation of the blower wheel draws air from the drum 30 through the lint catcher 68 and drum outlet conduit 70. In turn, this causes air to be drawn into the drum through the drum inlet conduit 64 from the heater element housing 62 and the air inlet 61. Once the air passes through the blower housing 72, the blower wheel pushes the air through the exhaust conduit 74 and through the exhaust outlet 75.

The controller 100 operates the thermostat 77 which controls the heating element 76. If the heating element 76 is on, the air passing over the heating element 77 is heated prior to entering the drum inlet conduit 64 and ultimately the drum 30. The heated air passes over and through the damp clothes causing the moisture in the clothes to evaporate in the heated air. Clothes that are not clumped together dry faster as the clothes have more surface area for the heated air to contact. The moisture content of the air passing thorough the exhaust conduit 74 may be measured for dryer performance and may alter the cycle time based on predetermined settings from the control panel 18 and/or logic within the controller 100. Alternatively, the heating element may be off and then unheated air is drawn into the drum 30.

As the drum 30 spins, friction is created as the clothes rub against each other, and/or as layers of one piece of clothing rub against other layers. This friction creates a buildup of static electrical charge which is stored in the fabric of the clothes. Some portions of the clothes gain electrons and other lose electrons resulting in the clothes, or layers of a clothing article, to cling together due to the positive and negative charges attracting to each other. In the disclosed embodiment, the baffles 35 are impregnated with conductive material in order to cancel some of the static electrical charge. More specifically, the conducive polymer composition of the baffles 35 serves as a "short" circuiting member so as to cause charge cancellation on the portions of the drying clothing that make contact with the electrically conductive baffles 35. However, baffles 35 cannot generally absorb electric charge at the rate it is being generated as the static electric charge in the clothes increases over time.

Figure 5:
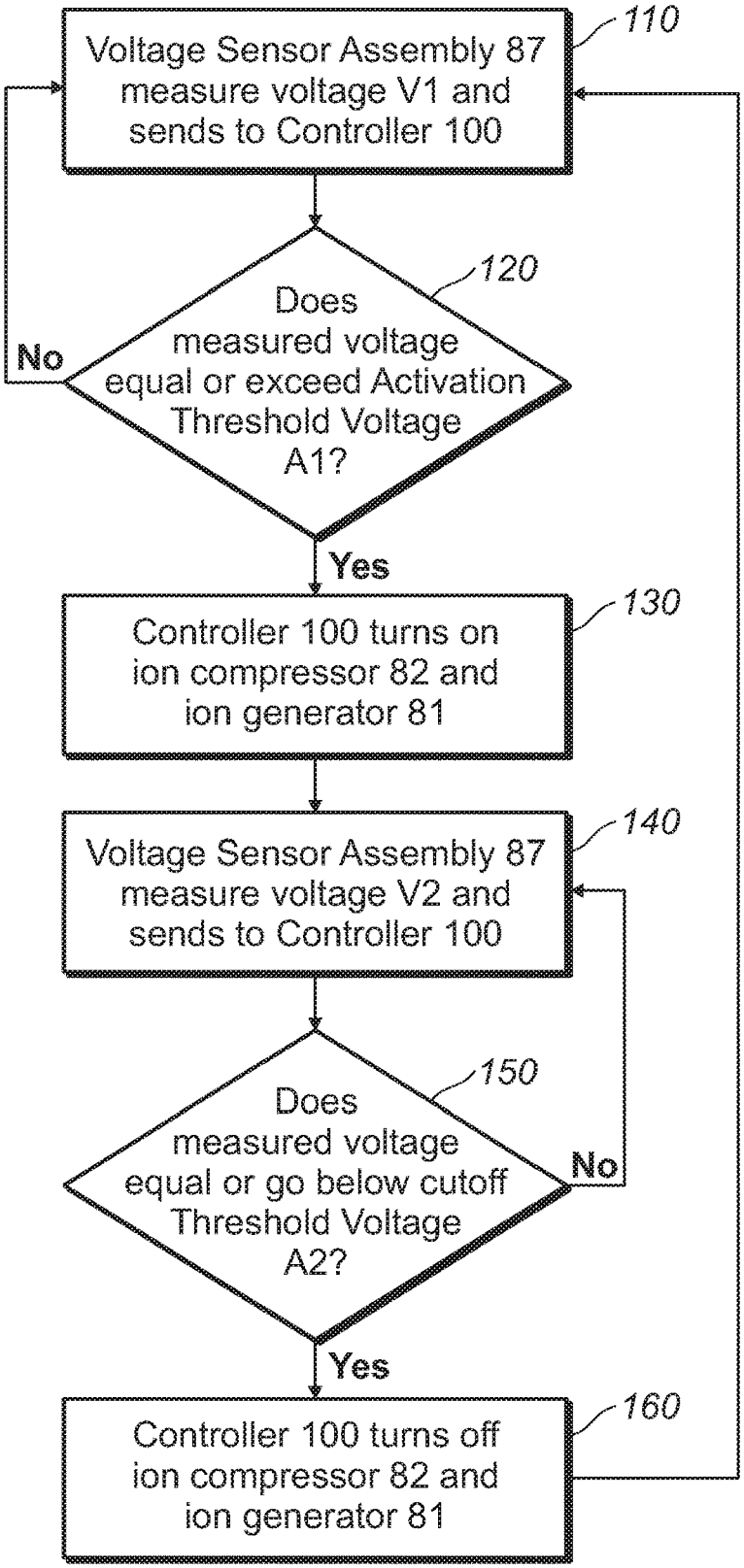
FIG. 5 is a flow chart showing the operation of an embodiment of the clothes dryer static electricity reduction system.

As seen in FIG. 5, during operation and while the drum 30 is rotating, the ion system 80 continuously measures the electrical charge within the drum 30. As the drum spins, the clothes tumble and periodically contact the two metal contact strips 90 of the sensor 88. Upon contact, the voltmeter measures 110 the voltage and electronically sends the voltage measurement V1 to the controller 100. The controller 100 compares 120 the absolute value of the measured voltage V1 to a predetermined activation threshold voltage A1. The predetermined activation threshold voltage A1 may be set to at 200 volts. If the absolute value of the measure voltage V1 is less than the predetermined activation threshold voltage A1 then measurements 110 are repeated. If the measured voltage V1 is equal to or exceeds the predetermined activation threshold voltage A1 then the controller 100 activates the ion generator 81 and air compressor 82 via electronic signal 130. As seen in FIGS. 1-4, when the ion generator 81 and air compressor 82 are turned on, the air compressor 82 forces air through the conduit 83. The ion generator 81 creates ions and introduces those ions into the air stream of the conduit 83. The air compressor may modulate the air flow to create varied levels of ion penetration into the clothes. The ion rich air is forced through the ion inlet 86 where it enters the drum 30. The ions in the ion rich air interact with the cations and anions of the electrically charged clothing to neutralize the charge.

Referring back to FIG. 5, the voltmeter 89 to measures voltage obtained from the sensor 88 during the operation of the ion generator 81 and air compressor 82 and sends the measured voltage V2 to the controller 100. The controller 100 compares 150 the absolute value of the measured voltage V2 to a predetermined cutoff threshold voltage A2. The predetermined cutoff threshold voltage A2 may be the same as the predetermined activation threshold voltage A1 or lower. If the absolute value of the measured voltage V2 is greater than the predetermined cutoff threshold voltage A2 then the measurements 140 are repeated. If the measured voltage V2 is equal to or less the predetermined cutoff threshold voltage A2 then the controller 100 shuts off the ion generator 81 and air compressor 82 via electronic signal 160. The voltmeter then measures 110 the voltage and electronically sends the voltage measurement V1 to the controller 100 and the cycle is repeated.

In a modification to the above, the controller 100 may not turn off the ion generator 81 and air compressor 82 until the predetermined threshold cutoff voltage A2 is reached and the ion generator 81 and air compressor 82 have run for a predetermined amount of time.

Figure 6:
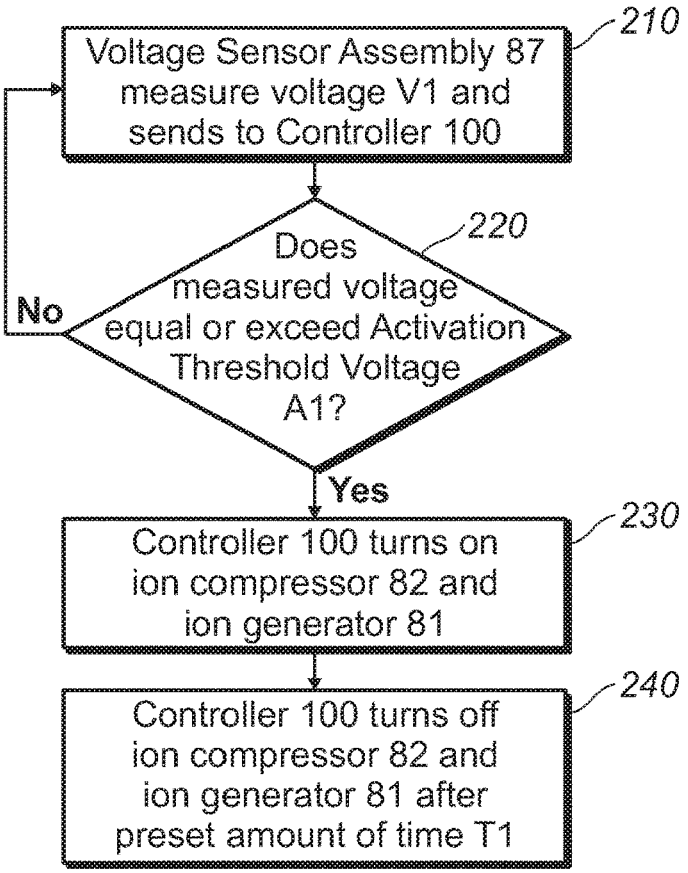
FIG. 6 is a flow chart showing the operation of an alternative embodiment of the clothes dryer static electricity reduction system.

The activation and run cycle of the ion generator 81 and air compressor 82 may be modified by settings on the control panel 18 and/or preprogrammed in the controller 100. In an alternative embodiment as disclosed in FIG. 6, the voltmeter measures 210 the voltage and electronically sends the voltage measurement V1 to the controller 100. The controller 100 compares 220 the absolute value of the measured voltage V1 to a predetermined activation threshold voltage A1. If the absolute value of the measure voltage V1 is less than the predetermined activation threshold voltage A1 then measurements 210 are repeated. If the measured voltage V1 is equal to or exceeds the predetermined activation threshold voltage A1 then the controller 100 activates the ion generator 81 and air compressor 82 via electronic signal 230. The controller 100 automatically turns off the ion generator 81 and air compressor 82 after a preset amount of time T1. After the ion cycle is terminated in this situation, the voltmeter measures 210 the voltage and the cycle is repeated.

In alternative embodiments, the heating element may be turned off while the ion generator 81 and ion compressor 82 are in operation.

Figure 7:
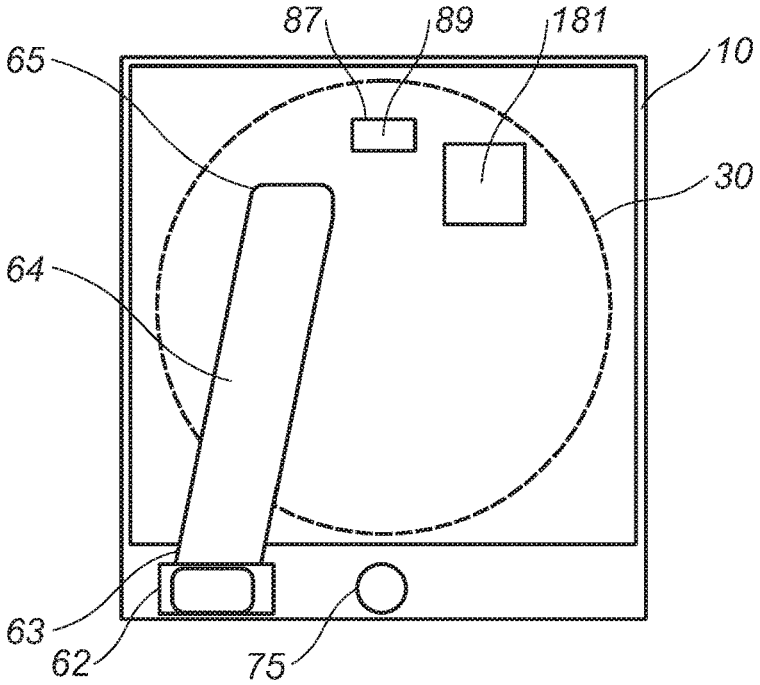
FIG. 7 is a rear view of a clothes dryer with a second embodiment of the clothes dryer static electricity reduction system.

As seen in FIG. 7, an alternative embodiment of the present invention does not utilize an air compressor in conjunction with the ion generator. Instead, the ion generator 181 is positioned on the interior panel 10 in direct communication with the ion inlet 86. In this embodiment, the voltage sensor assembly 87 may be integral with ion generator 181 or a separate component. In this embodiment, the controller 100 is programmed to turn on the ion generator 181 via electronic signal when the voltage, as determined by the voltmeter 89, reaches a predetermined activation threshold voltage A1 as disclosed in FIGS. 4 and 5. When the ion generator 181 is turned on, the ions are in direct contact with the ion inlet 86 where the ions are dispersed into the drum 30 by diffusion. The ions in the ion rich air interact with the cations and anions of the electrically charged clothing to neutralize the charge. During the operation of the ion generator 81 and air compressor 82, the voltmeter 89 continues to measure voltage obtained from the sensor 88. Once the voltage drops below the predetermined cutoff threshold voltage A2, the controller 100 sends an electronic signal to turns off the ion generator 181. The predetermined cutoff threshold voltage A2 may be the same as the predetermined activation threshold voltage A1 or lower. Furthermore, the controller 100 may not turn off the ion generator 110 until the predetermined threshold cutoff voltage A2 exists for a certain period of time such that the voltage measurements must remain below the predetermined cutoff threshold voltage A2 for a predetermined period of time. Ion generator 110 may be controlled by the controller 100 in the same manner as described for the embodiment encompassing an air compressor 82.

An exemplar source of ions is the ion generator made by Keyence, including the SJ series. Some ion generators have internal static sensing circuits, which would negate the need for voltage measuring circuit which would permit the voltage sensor assembly 87 to be integral with the ion generator 81, 110. In accordance with standard dryer fire safety, the last ten minutes or so of clothes drying makes use of tumbling only to help dissipate trapped/entrained heat flux within the fabric layers. This "cooling off" cycle remains subject to static electrical build up. By injecting the neutralizing ions during the cooling off period, the layers of fabric can better cool off in that they do not stick together as much.

While use of a controller or processor to control the operation of the ion generator 81, 100 is preferred, other circuit mechanisms may be employed such as causing an SPDT relay to energize, based on a preset voltage reading, that transfers power from the heating element to the ion generator based on the movement of the coil.

Figure 8:
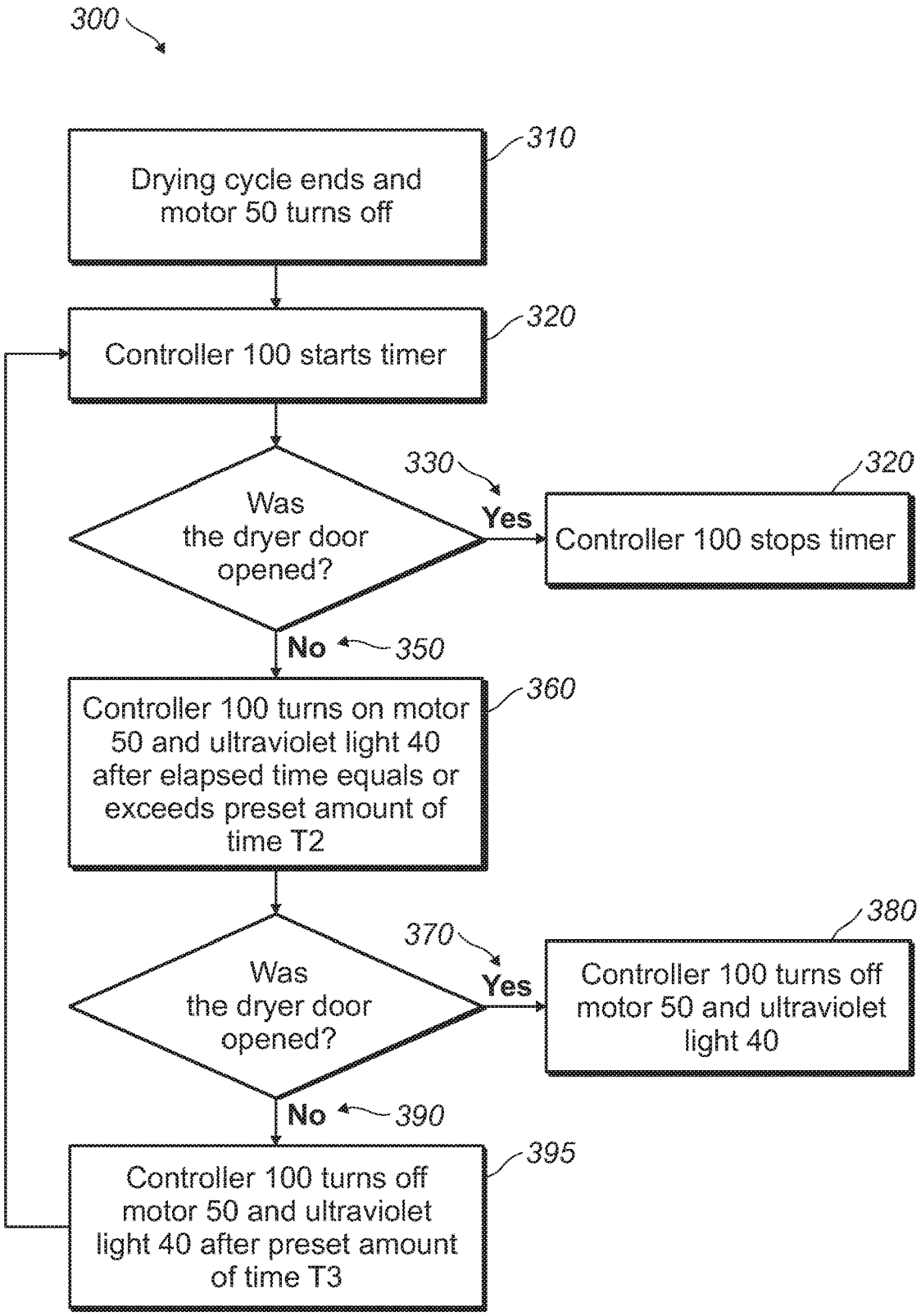
FIG. 8 is a flow chart showing the operation of an embodiment of the heat dissipation cycle of the clothes dryer static electricity reduction system.

As seen in FIG. 8 the heat dissipation cycle 300 selectively operates the motor 50 and ultraviolet light 40 depending on certain events. Once the drying cycle ends 310, meaning the drum 30 is no longer rotating, the controller 100 starts a timer 320. If the controller 100 receives a signal that the door 14 was opened 330, as detected by the door latch sensor 17, then the controller 100 stops the timer 340. If the door is opened, it is presumed the clothes were removed and/or ambient air was introduced into the drum 30 through door opening 13. If the controller 100 receives a signal that the door 14 was not opened 350, as through the failure to detect the opening of the door 14 by the door latch sensor 17, then the controller 100 turns on the motor 50 which permits the drum 30 to rotate and the ultraviolet light 40 after the elapsed time as determined by the timer equals or exceeds a preset amount of time T2 360. In the preferred embodiment, the preset amount of time T2 may be 30 minutes but any elapsed time period may be useful to assist in dissipating entrapped heat and microbe growth. If the controller 100 receives a signal that the door 14 is opened while the motor 50 and the ultraviolet light 40 are operating 370, then the controller 100 turns off the motor 50 and the ultraviolet light 40 380. If the door is not opened while the motor 50 and ultraviolet light 40 are operating 390, the controller 100 turns off the motor 50 and ultraviolet light 40 after a preset amount of time T3 395. In the preferred embodiment, the preset amount of time T3 may be 10 seconds but may be longer depending on dampness of clothes, amount of heat dissipation cycles 300 executed, or user preferences. The controller 100 then restarts the timer 320 and the heat dissipation cycle 300 is repeated.

It should be readily appreciated the heat dissipation cycle 300 may operate in a multitude of matters including linking the heat dissipation cycle 300 with a wrinkle resistant cycle, limiting the number of heat dissipation cycles 300, utilizing only the motor 50 and not utilizing the ultraviolet light 40, utilizing only the ultraviolet light 40 and not the motor 50, or utilizing the ultraviolet light 40 separate from motor 50. Furthermore, the preset amount of time T2 and preset amount of time T3 may be variable and/or dependent upon the number of heat dissipation cycles 300 executed. For example, the preset amount of time T2 may be shorter for the first heat dissipation cycle 300 and increase in length as more heat dissipation cycles 300 are executed. Moreover, the preset amount of time T3 may be longer the first heat dissipation cycle 300 and decrease in length as more heat dissipation cycles 300 are executed.

The embodiment has been described with reference to a standard dryer cabinet. Those skilled in the art understand that the static electricity reduction system disclosed can be modified to be used in any dryer. The components can be arranged differently and mounted in different places within the interior of the dryer. Additionally, the source of heat could be a fueled gas burner, as opposed to a resistance heater. The conductive polymer fins can also be made from a conductive metal. It is also anticipated that some clothes/fibers may dry better if both heated air and injection of ions by way of compressed air are carried out simultaneously.

The invention claimed is:

1. A static electricity reduction system for a clothes dryer comprising:

a drum for receiving clothing;

a voltage sensor positioned to measure the voltage of at least a portion of the clothing within the drum;

an ion source in fluid communication with the interior of the drum; and a controller in electrical communication with the voltage sensor and the ion source wherein the controller activates the ion source upon the voltage sensor measuring a predetermined activation threshold voltage and deactivates the ion source upon the voltage sensor measuring a predetermined cutoff threshold voltage; and a heat source in fluid communication with the interior of the drum wherein the controller is programmed to cycle between periods in which the heat source is on and the ion source is off and periods in which the heat source is off and the ion source is on.

2. The static electricity reduction system for a clothes dryer of claim 1 wherein the controller deactivates the ion source upon the passage of a predetermined amount of time.

3. The static electricity reduction system for a clothes dryer of claim 1 wherein the ion source further comprises an ion generator fluidly connected to an air compressor.

4. The static electricity reduction system for a clothes dryer of claim 3 wherein the air compressor is a modulating air compressor.

5. The static electricity reduction system for a clothes dryer of claim 1 wherein a non-metallic conduit connects the ion source to the drum.

6. The static electricity reduction system for a clothes dryer of claim 3 wherein a non-metallic conduit connects the ion source to the drum.

7. The static electricity reduction system for a clothes dryer of claim 1 further comprising an ultraviolet light source in visual communication with the interior of the drum.

8. The static electricity reduction system for a clothes dryer of claim 1 further comprising at least one baffle within the drum wherein the baffle contains a conductive material.

9. The static electricity reduction system for a clothes dryer of claim 8 wherein the baffle is a plastic material containing carbon fiber or aluminum shards.

* * * * *